US010947701B2

(12) United States Patent
Hyodo et al.

(10) Patent No.: US 10,947,701 B2
(45) Date of Patent: Mar. 16, 2021

(54) WORKING VEHICLE

(71) Applicant: HITACHI CONSTRUCTION MACHINERY CO., LTD., Tokyo (JP)

(72) Inventors: Koji Hyodo, Kasumigaura (JP); Tetsuji Tanaka, Abiko (JP); Isamu Aoki, Tsukuba (JP); Masaki Nukii, Ushiku (JP); Yuki Ahiko, Abiko (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 0 days.

(21) Appl. No.: 16/980,055

(22) PCT Filed: Sep. 24, 2019

(86) PCT No.: PCT/JP2019/037307
§ 371 (c)(1),
(2) Date: Sep. 11, 2020

(87) PCT Pub. No.: WO2020/067029
PCT Pub. Date: Apr. 2, 2020

(65) Prior Publication Data

US 2021/0002865 A1 Jan. 7, 2021

(30) Foreign Application Priority Data

Sep. 28, 2018 (JP) ..... JP2018-183909

(51) Int. Cl.
*E02F 9/22* (2006.01)
*F02D 29/04* (2006.01)

(52) U.S. Cl.
CPC ..... *E02F 9/2235* (2013.01); *E02F 9/2253* (2013.01); *E02F 9/2289* (2013.01); *E02F 9/2296* (2013.01); *F02D 29/04* (2013.01)

(58) Field of Classification Search
CPC .. F16H 61/4017; F16H 61/421; E02F 9/2253; E02F 9/2289; E02F 9/2235
See application file for complete search history.

(56) References Cited

U.S. PATENT DOCUMENTS 8,261,544 B2 * 9/2012 Basana ..... F16H 61/431 60/436
8,327,638 B2 * 12/2012 Ohtsukasa ..... F16H 61/431 60/445

(Continued)

FOREIGN PATENT DOCUMENTS

JP 2001-295682 A 10/2001
JP 2008-223307 A 9/2008

(Continued)

OTHER PUBLICATIONS

International Search Report of PCT/JP2019/037307 dated Dec. 3, 2019.

*Primary Examiner* — Abiy Teka
(74) *Attorney, Agent, or Firm* — Mattingly & Malur, PC

(57) ABSTRACT

Provided is a working vehicle capable of, while reducing fuel consumption, improving traveling performance only when high traveling performance is required.

A wheel loader 1 comprises: an engine 3; a variable displacement HST pump 41; a variable displacement HST motor 42 connected to the HST pump 41 through a closed circuit; pressure sensors 72A, 72B configured to load pressure of the HST motor 42; and a controller 5, wherein the controller 5 is configured to, in a case of determining that a load pressure detection value P is included in a predetermined pressure range of greater than load pressure Pα corresponding to flat ground traveling and smaller than load pressure Pγ corresponding to an excavation operation, (Continued)

increase maximum rotational speed of the engine 3 only within the predetermined pressure range.

5 Claims, 11 Drawing Sheets

(56) References Cited

U.S. PATENT DOCUMENTS

| | | | | |
|---|---|---|---|---|
| 8,540,048 | B2 * | 9/2013 | Will | F16H 61/431 180/338 |
| 8,683,794 | B2 * | 4/2014 | Fukuda | F16H 61/431 60/431 |
| 8,701,818 | B2 * | 4/2014 | Shirao | E02F 9/2289 180/305 |
| 9,096,989 | B2 * | 8/2015 | Callaway | E02F 9/2235 |
| 9,617,716 | B2 * | 4/2017 | Hyodo | F02D 41/0235 |

FOREIGN PATENT DOCUMENTS

| | | | |
|---|---|---|---|
| JP | 2015-071976 | A | 4/2015 |
| JP | 2017-115832 | A | 6/2017 |
| WO | 2010/116853 | A1 | 3/2010 |

* cited by examiner

WORKING VEHICLE

TECHNICAL FIELD

The present invention relates to a working vehicle equipped with a traveling drive system which employs a continuously variable transmission.

BACKGROUND ART

There has been known a working vehicle such as a wheel loader, a forklift, and a tractor, which is provided with, as a traveling drive system employing a continuously variable transmission, an HST (Hydraulic Static Transmission) traveling drive system. In the HST traveling drive system, an engine drives a hydraulic pump to generate hydraulic pressure, and a hydraulic motor converts the generated hydraulic pressure to rotational force.

For example, Patent Literature 1 discloses a wheel loader comprising: an engine, a traveling hydraulic pump configured to be driven by the engine, an accelerator pedal configured to adjust accelerator opening in accordance with a step-on amount thereof, a traveling hydraulic motor configured to be driven by pressure oil discharged from the traveling hydraulic pump, a traveling load detection section configured to detect magnitude of traveling load applied during traveling, a vehicle speed detection section configured to detect vehicle speed, and a control device configured to control the engine.

In the wheel loader of the Patent Literature 1, the control device is configured to control the engine in accordance with the magnitude of the traveling load detected by the traveling load detection section and the vehicle speed detected by the vehicle detection section, thereby realizing traveling at the maximum vehicle speed while suppressing fuel consumption. Specifically, an accelerator opening limit amount is set to be greater as the vehicle speed approaches the maximum vehicle speed and smaller as the vehicle speed is farther away from the maximum vehicle speed, and when the traveling load is small, is set to be smaller than the one in a case where the traveling load is high.

CITATION LIST

Patent Literature

[Patent Literature 1] WO 2010/116853 A

SUMMARY OF INVENTION

Technical Problem

However, according to the engine control by the wheel loader disclosed in Patent Literature 1, when the traveling load is high and the vehicle speed is very low, the rotational speed of the engine becomes high. As a case where the traveling load is high and the vehicle speed is very low, for example, a case of while an excavation operation or a forward/reverse changeover operation is performed is conceivable. Since the traction force is constant at a maximum value during the excavation operation, even when increasing the engine rotational speed, traveling performance cannot be improved, and on the other hand, when the engine rotational speed is increased although there is no need to improve the traveling performance, the fuel consumption deteriorates. Furthermore, when increasing the engine rotational speed during the forward/reverse changeover operation, the vehicle speed is suddenly decelerated and thus smooth traveling is less likely to be performed.

An object of the present invention is to provide a working vehicle capable of, while reducing fuel consumption, improving traveling performance only when high traveling performance is required.

Solution to Problem

In order to achieve the object above, the present invention provides a working vehicle comprising: an engine; a variable displacement traveling hydraulic pump that is driven by the engine; and a variable displacement traveling hydraulic motor that is connected to the traveling hydraulic pump through a closed circuit and transmits drive force of the engine to wheels, wherein the working vehicle further comprises: a pressure sensor configured to detect load pressure of the traveling hydraulic motor; and a controller configured to control the engine and the traveling hydraulic motor, the controller is further configured to: determine whether a pressure detection value detected by the pressure sensor is included in a predetermined first pressure range of greater than load pressure of the traveling hydraulic motor corresponding to a state where the working vehicle is traveling on a flat ground, or a predetermined second pressure range of greater than the load pressure of the traveling hydraulic motor corresponding to the state where the working vehicle is traveling on the flat ground and smaller than load pressure of the traveling hydraulic motor corresponding to a state where work requiring maximum traction force of the working vehicle is performed; and in a case of determining that the pressure detection value detected by the pressure sensor is included in the predetermined first pressure range or the predetermined second pressure range, output a motor command signal to the traveling hydraulic motor so as to increase displacement volume of the traveling hydraulic motor from a minimum value to a maximum value within the predetermined first pressure range or the predetermined second pressure range, and output an engine command signal to the engine so as to increase maximum rotational speed of the engine only within the predetermined first pressure range or the predetermined second pressure range.

Advantageous Effects of Invention

According to the present invention, it is possible to, while reducing fuel consumption, improve traveling performance only when high traveling performance is required. The problems, configurations, and effects other than those described above will be clarified by explanation of the embodiments below.

BRIEF DESCRIPTION OF DRAWINGS

FIG. 6(*b*) illustrates a graph showing relationship between engine rotational speed and HST pump input torque.

FIG. 6(*c*) illustrates a graph showing relationship between engine rotational speed and an HST pump discharge flow rate.

DESCRIPTION OF EMBODIMENTS

Hereinafter, as an aspect of a loading vehicle according to an embodiment of the present invention, a wheel loader will be described.

(Overall Configuration of Wheel Loader 1)

First, an overall configuration of a wheel loader 1 according to an embodiment of the present invention will be described with reference to FIG. 1.

Figure 1:
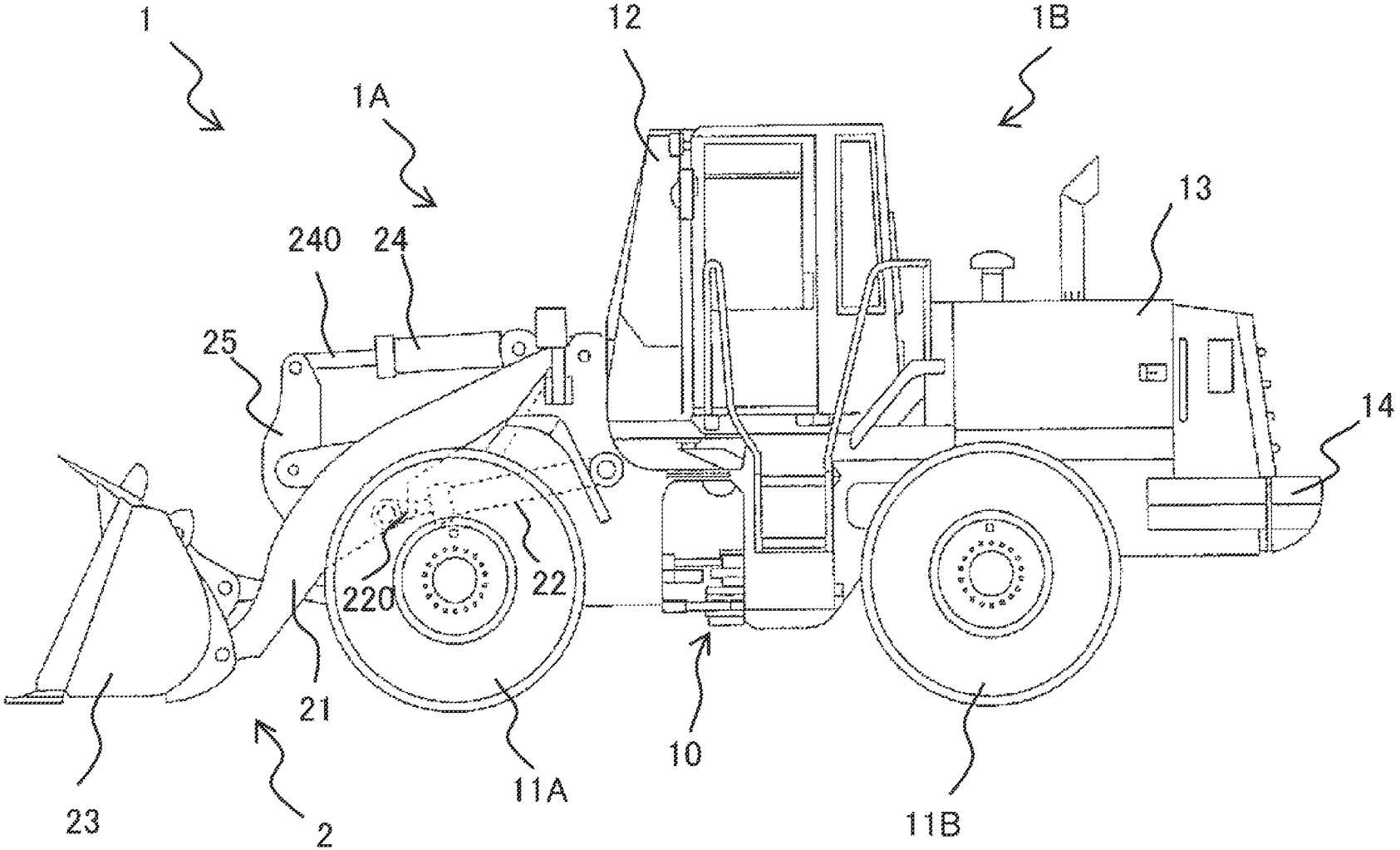
FIG. 1 is a side view illustrating appearance of a wheel loader according to an embodiment of the present invention.

FIG. 1 is a side view illustrating appearance of the wheel loader 1 according to the embodiment of the present invention.

The wheel loader 1 is provided with a vehicle body which includes a front frame 1A and a rear frame 1B, and a working device 2 which is disposed on a front portion of the vehicle body and excavates an object to be excavated. The wheel loader 1 is an articulated type working vehicle which is swiveled on a central portion of the vehicle body and steered thereby. In particular, the front frame 1A and the rear frame 1B are connected to each other by a center joint 10 to swivel in the left and right direction so that the front frame 1A is bent in the left and right directions with respect to the rear frame 1B.

The front frame 1A is provided with a pair of left and right front wheels 11A, and the rear frame 1B is provided with a pair of left and right rear wheels 11B, respectively. FIG. 1 illustrates only the front wheel 11A and the rear wheel 11B, which are disposed on the left side, of the pair of left and right front wheels 11A and the pair of left and right rear wheels 11B.

The rear frame 1B is provided with an operator's cab 12 to be boarded by an operator, a mechanical room 13 in which devices such as an engine, a controller, hydraulic pumps, etc. are accommodated, and a counterweight 14 for maintaining balance between the vehicle body and the working device 2 to prevent the vehicle body from tilting. On the rear frame 1B, the operator's cab 12 is disposed on the front, the counterweight 14 is disposed on the rear, and the mechanical room 13 is disposed between the operator's cab and the counterweight 14, respectively.

The working device 2 includes a lift arm 21 attached to the front frame 1A, a pair of lift arm cylinders 22 configured to expand and contract to rotate the lift arm 21 in the vertical direction with respect to the front frame 1A, a bucket 23 attached to the front end portion of the lift arm 21, a bucket cylinder 24 configured to expand and contract to rotate the bucket 23 in the vertical direction with respect to the lift arm 21, a bell crank 25 that is rotatably connected to the lift arm 21 and constitutes a link mechanism between the bucket 23 and the bucket cylinder 24, and a plurality of pipelines (not illustrated) for leading pressure oil to the pair of lift arm cylinders 22 and the bucket cylinder 24. FIG. 1 illustrates only one of the pair of lift arm cylinders 22, which is disposed on the left side, by indicating it with a broken line.

The lift arm 21 is rotated in the upward direction by expansion of a rod 220 of each of the lift arm cylinders 22, and rotated in the downward direction by contraction of each rod 220. The bucket 23 is tilted (rotated in the upward direction with respect to the lift arm 21) by expansion of a rod 240 of the bucket cylinder 24, and dumped (rotated in the downward direction with respect to the lift arm 21) by contraction of the rod 240.

The wheel loader 1 is a loading vehicle configured to perform loading work by excavating such as earth and sand and minerals which are objects to be excavated in a strip mine, etc. by means of the working device 2, and loading them into such as a dump truck.

Next, V-shape loading which is one of the methods used when the wheel loader 1 performs excavation work and loading work will be described with reference to FIG. 2.

Figure 2:
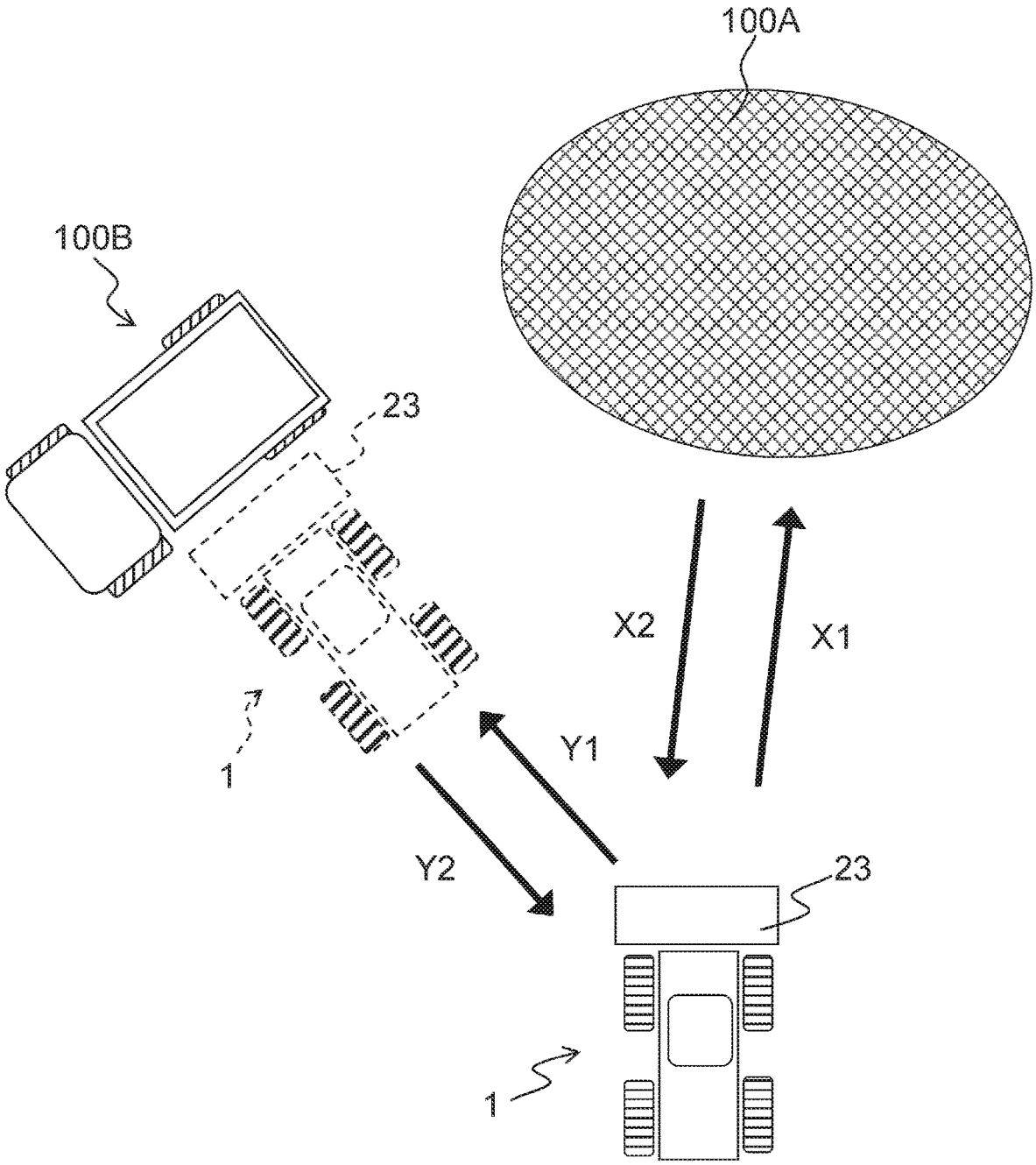
FIG. 2 explains V-shape loading performed by a wheel loader.

FIG. 2 explains the V-shape loading performed by the wheel loader 1.

Firstly, the wheel loader 1 moves forward toward the natural ground 100A which is an object to be excavated (arrow X1 illustrated in FIG. 2), and performs excavation work by tilting the bucket 23 in a state of making the bucket 23 thrust into the natural ground 100A. When completing the excavation work, the wheel loader 1 temporarily moves backward to the original position in a state where the load such as the excavated earth and sand and minerals is loaded on the bucket 23 (arrow X2 illustrated in FIG. 2).

Subsequently, the wheel loader 1 moves forward toward a dump truck 100B which is a loading destination of the load in the bucket 23 (arrow Y1 illustrated in FIG. 2), and stops in front of the dump truck 100B. FIG. 2 illustrates the wheel loader 1 in a state of being stopped in front of the dump truck 100B by indicating it with a broken line.

When completing the loading work by loading the load onto the dump truck 100B, the wheel loader 1 moves backward to the original position in a state in which no load is mounted in the bucket 23 (arrow Y2 illustrated in FIG. 2). In this manner, the wheel loader 1 travels reciprocally along V-shape between the natural ground 100A and the dump truck 100B, and performs excavation work and loading work.

Depending on an environment of a work site, the wheel loader 1 travels on steep slope, or performs dozing work for leveling a work surface by using the working device 2. In various operations of the wheel loader 1, there are cases such as a case where vehicle speed needs to be increased, a case where traction force needs to be applied, or a case where both of them are required.

Next, relationship between the vehicle speed and the traction force of the wheel loader 1, in other words, traveling performance of the wheel loader 1 will be described with reference to FIG. 3.

Figure 3:
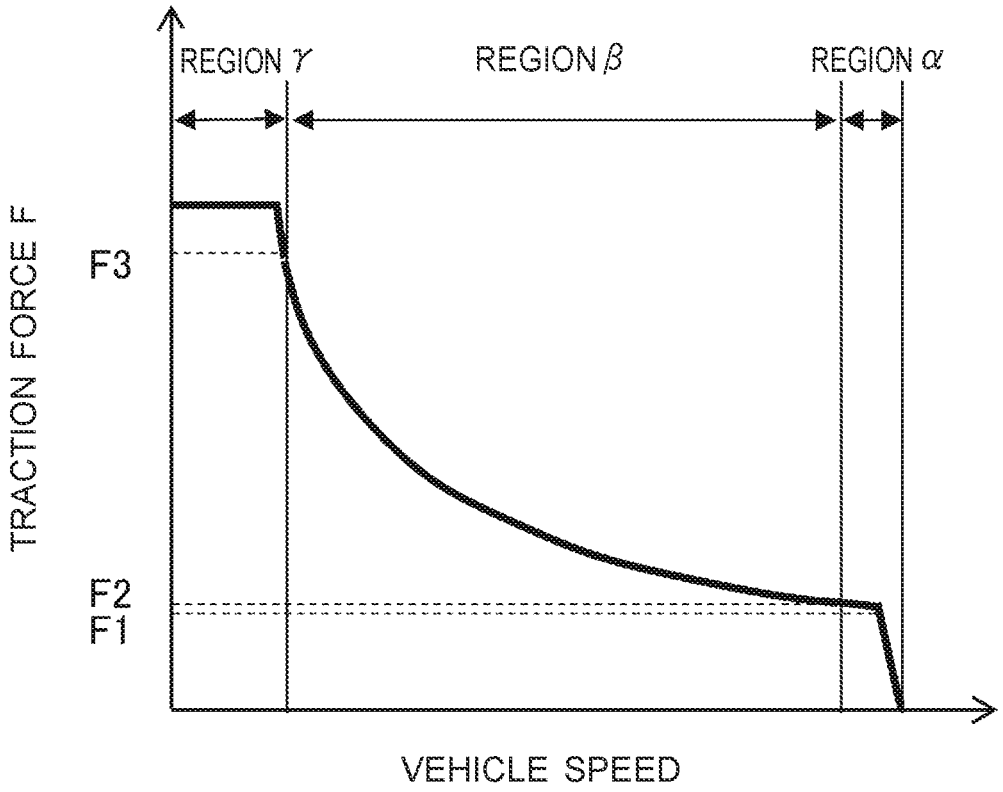
FIG. 3 illustrates a graph showing relationship between vehicle speed and traction force.

FIG. 3 illustrates a graph showing relationship between the vehicle speed and the traction force.

A region α illustrated in FIG. 3 indicates an operation in which the traction force F of the vehicle body may be relatively small while the vehicle speed is the maximum vehicle speed. This operation corresponds to, for example, a case in which the wheel loader 1 is traveling on the flat ground in a state where a lifting operation is not performed by the work device 2. In this connection, the traction force F1 illustrated in FIG. 3 is the traction force required while the wheel loader 1 is traveling on the flat ground at the maximum vehicle speed.

A region γ illustrated in FIG. 3 indicates an operation in which, while the vehicle speed is zero or very low, the maximum traction force is required as the traction force F of the vehicle body. For example, it corresponds to an excavation operation performed by the working device 2.

A region β illustrated in FIG. 3 corresponds to a region between the region γ and the region α. This region indicates an operation in which both the traction force and the vehicle speed of the vehicle body are required, for example, corresponds to a case where the wheel loader 1 climbs the slope (during hill climbing) or performs a dozing operation. The traction force F of the vehicle body in the region β varies between the traction force F2, which is greater than the traction force F1 and required at the time of travelling on the flat ground at the maximum vehicle speed, and the traction force F3 which is smaller than the maximum traction force ($F2 \leq F \leq F3$), and the vehicle speed in the region β varies between 0 or very low speed and the maximum vehicle speed.

(Drive System of Wheel Loader 1)

Next, a drive system of the wheel loader 1 will be described with reference to FIGS. 4 to 6.

Figure 4:
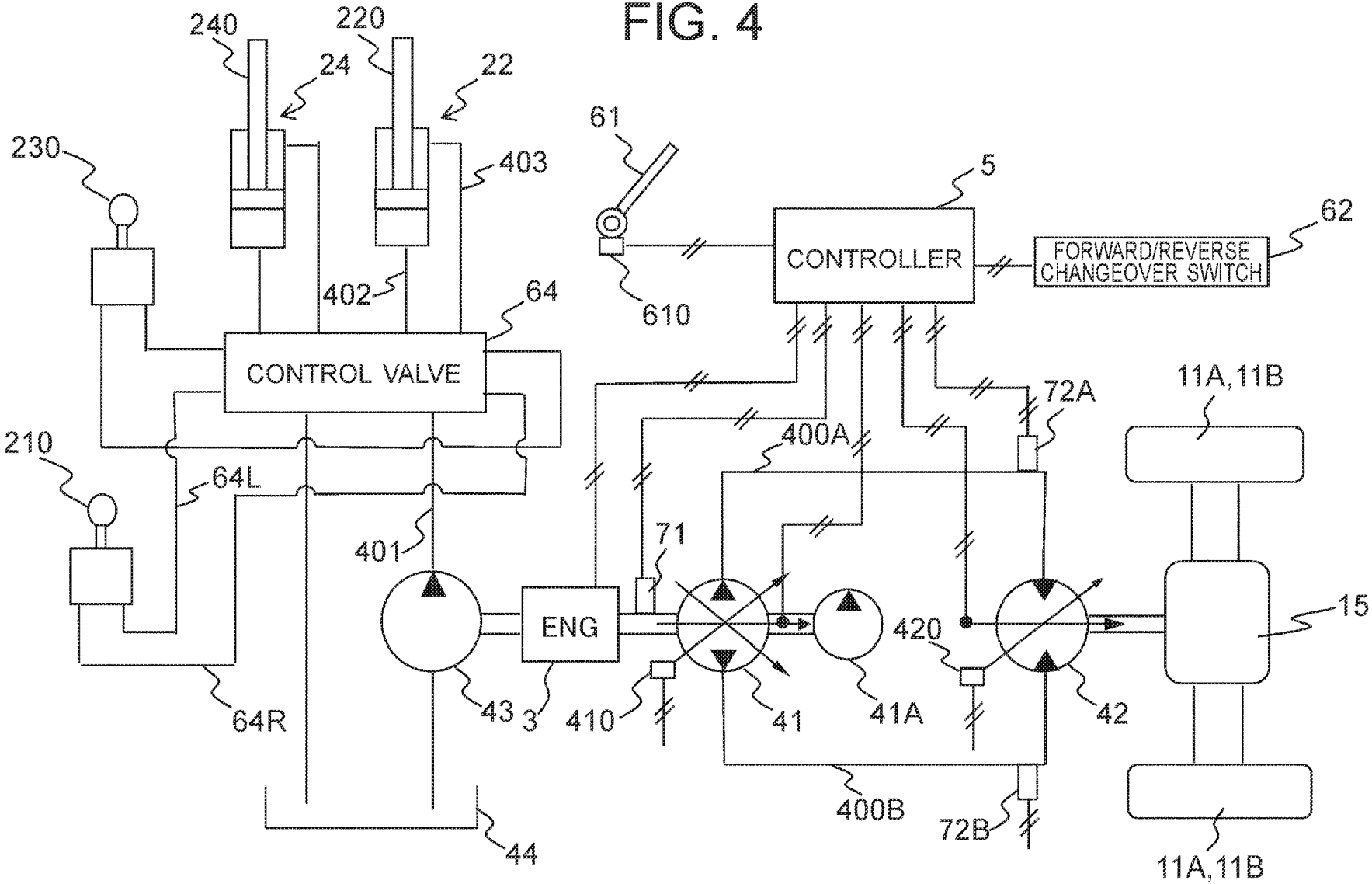
FIG. 4 illustrates a hydraulic circuit and an electric circuit of a wheel loader.

FIG. 4 illustrates a hydraulic circuit and an electric circuit of the wheel loader 1. FIG. 5 illustrates a graph showing relationship between an accelerator pedal step-on amount and target engine rotational speed. FIG. 6(*a*) illustrates a graph showing relationship between engine rotational speed and displacement volume of an HST pump 41. FIG. 6(*b*) illustrates a graph showing relationship between the engine rotational speed and input torque of the HST pump 41. FIG. 6(*c*) illustrates a graph showing relationship between the engine rotational speed and a discharge flow rate of the HST pump 41.

The wheel loader 1 according to the present embodiment includes an HST traveling drive device having a hydraulic circuit which is a closed circuit. The HST traveling drive device includes, as illustrated in FIG. 4, an engine 3, the HST pump 41 as a traveling hydraulic pump driven by the engine 3, an HST charge pump 41A configured to supply pressure oil for controlling the HST pump 41, an HST motor 42 as a traveling hydraulic motor connected to the HST pump 41 through a closed circuit via a pair of pipelines 400A, 400B, and a controller 5 configured to control each device such as the engine 3, the HST pump 41, and the HST motor 42.

The HST pump 41 is a swash plate type or a swash shaft type variable displacement hydraulic pump in which the displacement volume is controlled in accordance with a tilt angle. The tilt angle is adjusted by a pump regulator 410 in accordance with a command signal output from the controller 5.

The HST motor 42 is a swash plate type or a swash shaft type variable displacement hydraulic motor in which the displacement volume is controlled in accordance with a tilt angle, and transmits the drive force of the engine 3 to the wheels (front wheels 11A and rear wheels 11B). Similarly to the case of the HST pump 41, the tilt angle is adjusted by a motor regulator 420 in accordance with a command signal output from the controller 5.

In the HST traveling drive device, firstly, when the operator steps on an accelerator pedal 61 provided in the operator's cab 12, the engine 3 is rotated, and the HST pump 41 is driven by the drive force of the engine 3. Then, the HST motor 42 is rotated by the pressure oil discharged from the HST pump 41, and the output torque from the HST motor 42 is transmitted to the front wheels 11A and the rear wheels 11B via an axle 15, which makes the wheel loader 1 travel.

Specifically, a step-on amount sensor 610 attached to the accelerator pedal 61 detects a step-on amount of the accelerator pedal 61, and the detected step-on amount is input to the controller 5. Then, target engine rotational speed corresponding to the step-on amount which has been input is output from the controller 5 to the engine 3 as a command signal. The rotational speed of the engine 3 is controlled in accordance with this target engine rotational speed. As illustrated in FIG. 4, an engine rotational speed sensor 71 provided on an output shaft of the engine 3 detects the rotational speed of the engine 3.

Figure 5:
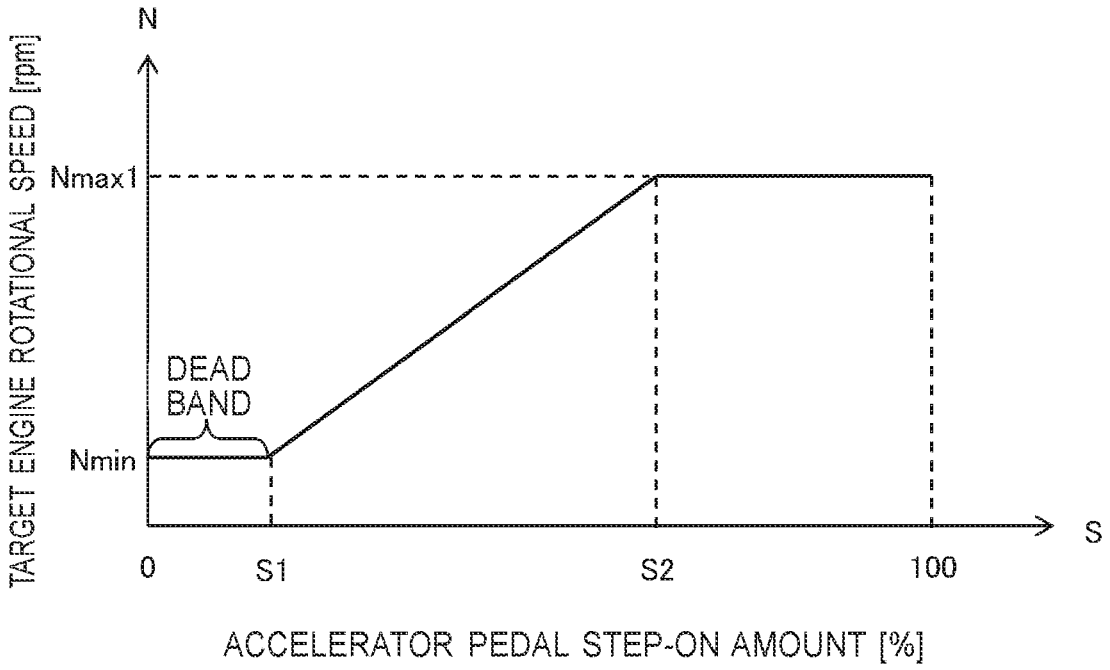
FIG. 5 illustrates a graph showing relationship between an accelerator pedal step-on amount and target engine rotational speed.

As illustrated in FIG. 5, the step-on amount of the accelerator pedal 61 is proportional to the target engine rotational speed, and thus the target engine rotational speed increases as the step-on amount of the accelerator pedal 61 increases. When the step-on amount of the accelerator pedal 61 reaches S2, the target engine rotational speed becomes the maximum rotational speed Nmax1. The maximum rotational speed Nmax1 of the engine 3 (hereinafter, referred to as "first engine maximum rotational speed Nmax1") is a set value corresponding to a state where the wheel loader 1 is traveling on the flat ground with the working device 2 being not operated (non-operating state) or a state where the working device 2 is operated to perform excavation, which is a value at which the fuel efficiency of the engine 3 is good.

In FIG. 5, a range where the step-on amount of the accelerator pedal 61 is 0 to S1 (for example, the range of 0% to 20% or 30%) is set as a dead band in which the target engine rotational speed is constant at predetermined minimum engine rotational speed Nmin, regardless of the step-on amount of the accelerator pedal 61. The range of the dead band can be arbitrarily set and changed.

Figure 6:
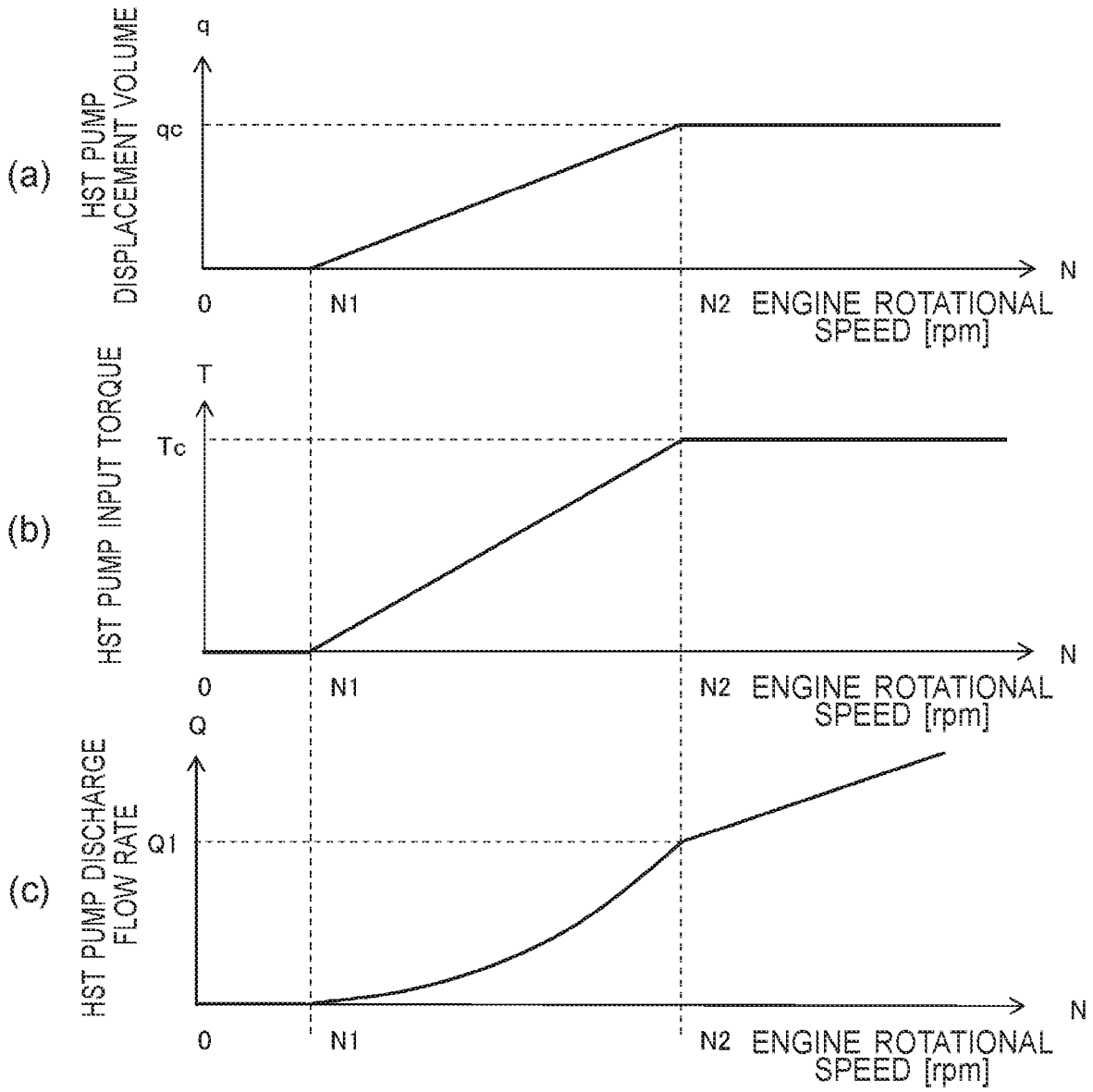
FIG. 6(*a*) illustrates a graph showing relationship between engine rotational speed and HST pump displacement volume.

The relationship between the engine 3 and the HST pump 41 is as illustrated in FIGS. 6(*a*) to 6(*c*).

As illustrated in FIG. 6(*a*), when the engine rotational speed is between N1 and N2, the rotational speed N of the engine 3 is proportional to the displacement volume q of the HST pump 41, and as the rotational speed of the engine 3 increases from N1 to N2 ($N1<N2$), the displacement volume increases from 0 to a predetermined value qc. When the engine rotational speed is equal to or greater than N2, the displacement volume of the HST pump 41 is constant at the predetermined value qc regardless of the engine rotational speed.

The input torque of the HST pump 41 is obtained by multiplying the displacement volume by the discharge pressure (input torque=displacement volume×discharge pressure). As illustrated in FIG. 6(*b*), when the engine rotational speed is between N1 and N2, the rotational speed N of the engine 3 is proportional to the input torque T of the HST pump 41, and as the rotational speed of the engine 3 increases from N1 to N2, the input torque increases from 0 to a predetermined value Tc. When the engine rotational speed is equal to or greater than N2, the input torque of the HST pump 41 is constant at the predetermined value Tc regardless of the engine rotational speed.

As illustrated in FIG. 6(*c*), when the engine rotational speed is between N1 and N2, the discharge flow rate Q of the HST pump 41 is quadratically proportional to the rotational speed N of the engine 3, and as the rotational speed of the engine 3 increases from N1 to N2, the discharge flow rate of the HST pump 41 increases from 0 to Q1. When the engine rotational speed is equal to or greater than N2, the rotational speed N of the engine 3 is linearly proportional to the discharge flow rate Q of the HST pump 41.

Accordingly, when the rotational speed N of the engine 3 increases, the discharge flow rate Q of the HST pump 41 increases, and the flow rate of the pressure oil flowing from the HST pump 41 into the HST motor 42 increases. As a result, the rotational speed of the HST motor 42 increases, and thus the vehicle speed increases.

The load pressure applied to the HST motor 42 is, while the wheel loader 1 is moving in the forward direction, detected by a first pressure sensor 72A provided on one pipeline 400A, and while the wheel loader 1 is moving in the reverse direction, detected by a second pressure sensor 72B provided on the other pipeline 400B (see FIG. 4). Each of the first pressure sensor 72A and the second pressure sensor 72B is an aspect of a pressure sensor configured to detect the load pressure of the HST motor 42 serving as a traveling hydraulic motor. In the following, there are cases where "the first pressure sensor 72A and the second pressure sensor 72B" are simply referred to as "the pressure sensors 72A, 72B".

As described above, in the HST traveling drive device, since the vehicle speed is controlled by continuously increasing or decreasing the discharge flow rate of the HST pump 41, the wheel loader 1 can smoothly start and stop with little impact. When controlling the vehicle speed, the discharge flow rate of the HST pump 41 is not necessarily adjusted, meanwhile, the displacement volume of the HST motor 42 may be adjusted. In the following, a case where the displacement volume of the HST motor 42 is adjusted will be described.

Selection of a traveling direction of the wheel loader 1, that is, selection of forward direction movement or reverse direction movement is performed by a forward/reverse changeover switch 62 (see FIG. 4) provided in the operator's cab 12. Specifically, when the operator switches the forward/reverse changeover switch 62 to a forward movement position, a forward/reverse changeover signal indicating the forward direction movement is input to the controller 5. The controller 5 outputs a command signal to the HST pump 41 to direct the pump tilt to the forward side, so that the vehicle body is directed to the forward direction by the pressure oil discharged from the HST pump 41. Then, the pressure oil discharged from the HST pump 41 is led to the HST motor 42, and the HST motor 42 is rotated in a direction corresponding to the forward movement, which moves the vehicle body in the forward direction. The reverse direction movement of the vehicle body is also switched by the same mechanism.

As illustrated in FIG. 4, the wheel loader 1 includes a loading hydraulic pump 43 driven by the engine 3 and configured to supply hydraulic oil to the working device 2, a hydraulic oil tank 44 configured to store the hydraulic oil, a lift arm operation lever 210 for operating the lift arm 21, a bucket operation lever 230 for operating the bucket 23, and a control valve 64 provided between each of the lift arm cylinder 22 and the bucket cylinder 24 and the loading hydraulic pump 43 and configured to control the flow of the hydraulic oil supplied from the loading hydraulic pump 43 to the lift arm cylinder 22 and the bucket cylinder 24, respectively.

In the present embodiment, a fixed hydraulic pump is used as the loading hydraulic pump 43, and is connected to the control valve 64 through a first pipeline 401. Each of the lift arm operation lever 210 and the bucket operation lever 230 is provided in the operator's cab 12 (see FIG. 1). For example, when the operator operates the lift arm operation lever 210, pilot pressure proportional to the operation amount is generated as an operation signal.

As illustrated in FIG. 4, the generated pilot pressure is led to a pair of pilot pipelines 64L, 64R connected to a pair of pressure receiving chambers of the control valve 64, and acts on the control valve 64. As a result, the spool in the control valve 64 strokes in accordance with the pilot pressure, and the flow direction and flow rate of the hydraulic oil are determined. The control valve 64 is connected to a bottom chamber of the lift arm cylinder 22 through a second pipeline 402, and is connected to a rod chamber of the lift arm cylinder 22 through a third pipeline 403.

The hydraulic oil discharged from the loading hydraulic pump 43 is led to the first pipeline 401, and then guided to the second pipeline 402 or the third pipeline 403 via the control valve 64. When being guided to the second pipeline 402, the hydraulic oil flows into the bottom chamber of the lift arm cylinder 22, whereby the rod 220 of the lift arm cylinder 22 expands and the lift arm 21 is lifted. On the other hand, when being guided to the third pipeline 403, the hydraulic oil flows into the rod chamber of the lift arm cylinder 22, whereby the rod 220 of the lift arm cylinder 22 contracts and the lift arm 21 is lowered.

The operation of the bucket 23 is performed in the same manner as the operation of the lift arm 21, that is, the pilot pressure generated in accordance with the operation amount of the bucket operation lever 230 acts on the control valve 64, whereby the opening region of the spool of the control valve 64 is controlled, and the amount of hydraulic oil flowing into and out of the bucket cylinder 24 is adjusted. Although not illustrated in FIG. 4, sensors and the like for detecting operation states of the lift arm 21 and the bucket 23 are also provided on each pipeline of the hydraulic circuit.

(Configuration of Controller 5)

Next, the configuration of the controller 5 will be described with reference to FIG. 7.

Figure 7:
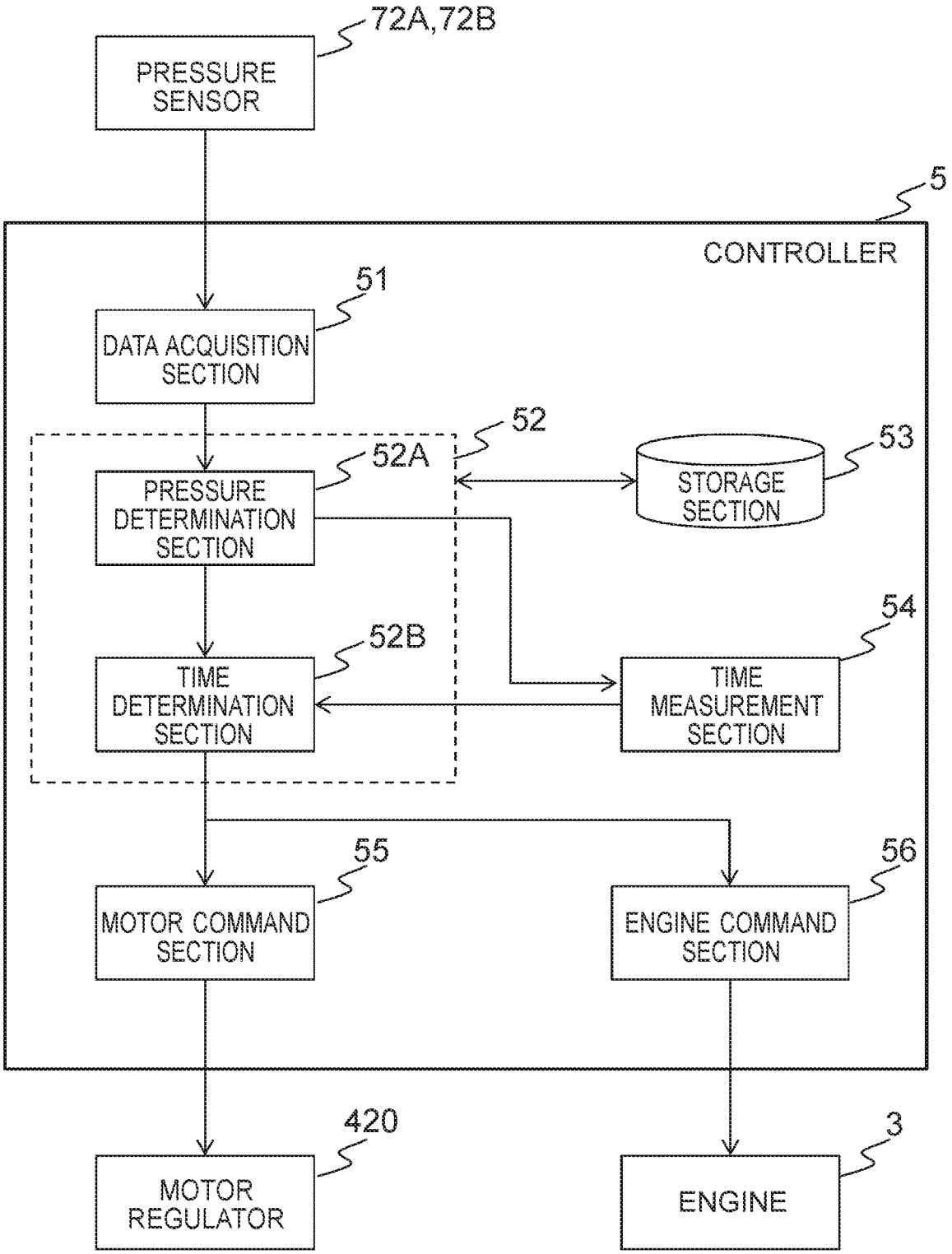
FIG. 7 is a functional block diagram illustrating functions of a controller.

FIG. 7 is a functional block diagram illustrating functions of the controller 5.

The controller 5 includes a CPU, a RAM, a ROM, an HDD, an input I/F, and an output I/F which are connected to each other via a bus. Various operation devices such as the lift arm operation lever 210, the bucket operation lever 230, the forward/reverse changeover switch 62, and various sensors such as the pressure sensors 72A, 72B and the step-on amount sensor 610 are connected to the input I/F. The pump regulator 410 for the HST pump 41, the motor regulator 420 for the HST motor 42, the engine 3, etc. are connected to the output I/F.

In this hardware configuration, the CPU reads out an arithmetic program (software) stored in a recording medium such as the ROM, the HDD, or an optical disk, expands it on the RAM, and executes the expanded arithmetic program.

Thereby, the arithmetic program and the hardware are operated in cooperation, which realizes the functions of the controller 5.

In the present embodiment, the controller 5 is described by a combination of software and hardware. Meanwhile, the present invention is not limited thereto, but an integrated circuit that realizes the functions of an arithmetic program executed on the side of the wheel loader 1 may be used.

As illustrated in FIG. 7, the controller 5 includes a data acquisition section 51, a determination section 52, a storage section 53, a time measurement section 54, a motor command section 55, and an engine command section 56.

The data acquisition section 51 acquires data relating to each load pressure detection value P output from the pressure sensors 72A, 72B, respectively. The determination section 52 includes a pressure determination section 52A and a time determination section 52B.

The pressure determination section 52A determines whether the load pressure detection value P acquired by the data acquisition section 51 is included in a predetermined pressure range of greater than load pressure Pα corresponding to flat ground traveling performed by the wheel loader 1 and smaller than load pressure Pγ corresponding to an excavation operation performed by the working device 2 (work requiring the maximum traction force of the vehicle body) (Pα<P<Pγ). That is, the "predetermined pressure range" corresponds to a range of the load pressure in the region β illustrated in FIG. 3.

The time determination section 52B determines whether a time t measured by the time measurement section 54, which will be described later, is equal to or more than a predetermined set time Tth. Here, the "predetermined set time Tth" is a time in which an operation corresponding to the region β, in other words, hill climbing or dozing work is being performed by the wheel loader 1 can be determined. The "predetermined set time Tth" is a time set to eliminate erroneous determination which may be made when the load pressure of the HST motor 42 becomes momentarily high, for example, when operations are switched or when an operator accidentally steps on the accelerator pedal 61. With this configuration, the erroneous determination by the determination section 52 is reduced, and thus the determination becomes more stable and the accuracy is increased.

The storage section 53 stores the load pressure Pα corresponding to the flat ground traveling performed by the wheel loader 1, the load pressure Pγ corresponding to the excavation operation performed by the working device 2, and the predetermined set time Tth, respectively.

The time measurement section 54 starts time measurement at the time when the pressure determination section 52A determines that the load pressure detection value P is included in a predetermined second pressure range (Pα<P<Pγ) so as to measure a time t while the load pressure detection value P is included in the predetermined second pressure range. Then, the time measurement section 54 stops the measurement of the time t and performs a reset operation when the pressure determination section 52A determines that the load pressure detection value P is not included in the predetermined pressure range (P≤Pα or P≥Pγ).

The motor command section 55 outputs a motor command signal to the motor regulator 420 for the HST motor 42 so as to increase the displacement volume q of the HST motor 42 from a minimum value qmin to a maximum value qmax in the predetermined pressure range, when the pressure determination section 52A determines that the load pressure detection value P is included in the predetermined pressure range (Pα<P<Pγ).

In the present embodiment, the motor command section 55 outputs the motor command signal to the motor regulator 420 for the HST motor 42 when the pressure determination section 52A determines that the load pressure detection value P is included in the predetermined pressure range (Pα<P<Pγ) as well as when the time determination section 52B determines that the measured time t is equal to or longer than the predetermined set time Tth (t≥Tth).

The engine command section 56 outputs an engine command signal to the engine 3 so as to increase the maximum rotational speed Nmax of the engine 3 from a first engine maximum rotational speed Nmax1 to a second engine maximum rotational speed Nmax2 that is greater than the first engine maximum rotational speed Nmax1 (Nmax2>Nmax1) only within the predetermined pressure range, when the pressure determination section 52A determines that the load pressure detection value P is included in the predetermined pressure range (Pα<P<Pγ).

In the present embodiment, the engine command section 56 outputs the engine command signal to the engine 3 when the pressure determination section 52A determines that the load pressure detection value P is included in the predetermined pressure range (Pα<P<Pγ) and when the time determination section 52B determines that the measured time t is equal to or more than the predetermined set time Tth (t≥Tth).

In the present embodiment, the engine command section 56 outputs a command signal to the engine 3 so as to return the maximum rotational speed of the engine 3, which has been increased to the second engine maximum rotational speed Nmax2, to the first engine maximum rotational speed Nmax1 when the pressure determination section 52A determines that the load pressure detection value P is not included in the predetermined pressure range (P≤Pα or P≥Pγ).

(Processing by Controller 5)

Next, a specific flow of processing executed by the controller 5 will be described with reference to FIG. 8.

Figure 8:
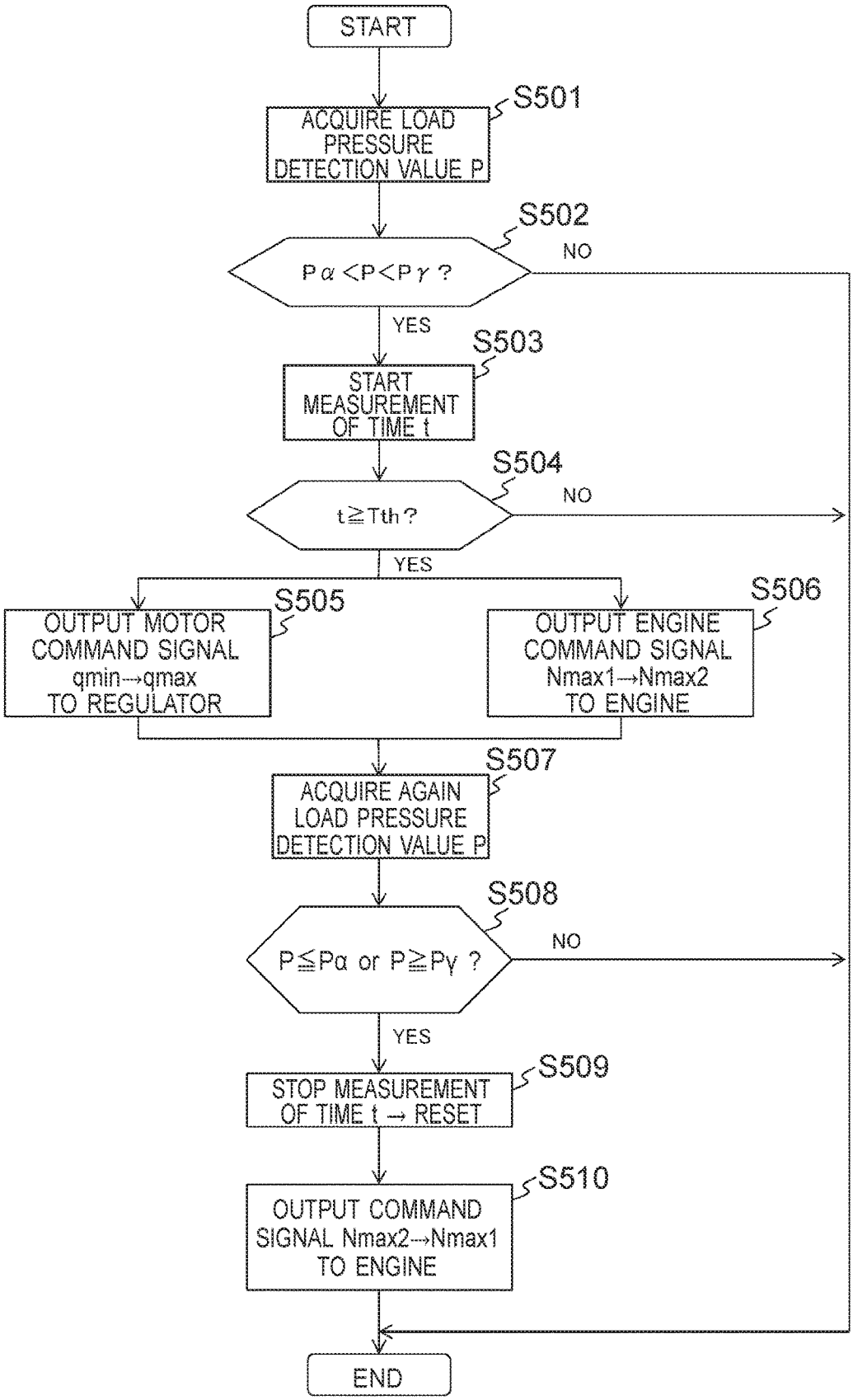
FIG. 8 illustrates a flowchart showing a flow of processing executed by a controller.

FIG. 8 illustrates a flowchart showing a flow of the processing executed by the controller 5.

First, the data acquisition section 51 acquires a load pressure detection value P output from the pressure sensors 72A, 72B (step S501).

Next, the pressure determination section 52A determines, based on the load pressure detection value P acquired in step S501, whether the load pressure detection value P is greater than the load pressure Pα corresponding to the flat ground traveling performed by the wheel loader 1 and is smaller than the load pressure Pγ corresponding to the excavation operation performed by the working device 2, in other words, whether the load pressure detection value P is included in the predetermined pressure range (step S502).

When it is determined in step S502 that the load pressure detection value P is included in the predetermined pressure range (Pα<P<Pγ) (step S502/YES), the time measurement section 54 starts measurement of a time t (step S503). Subsequently, the time determination section 52B determines whether the time t measured in step S503 is equal to or longer than the predetermined set time Tth (step S504).

When it is determined in step S504 that the measured time t is equal to or more than the predetermined set time Tth (t Tth) (step S504/YES), the motor command section 55 outputs a motor command signal to the motor regulator 420 so as to increase the displacement volume q of the HST motor 42 from the minimum value qmin to the maximum value qmax (step S505).

In addition, when it is determined in step S504 that the measured time t is equal to or more than the predetermined set time Tth (t≥Tth) (step S504/YES), the engine command section 56 outputs an engine command signal to the engine 3 so as to increase the maximum rotational speed Nmax of the engine 3 from the first engine maximum rotational speed Nmax1 to the second engine maximum rotational speed Nmax2 (>Nmax1) (step S506).

Next, the data acquisition section 51 acquires again the load pressure detection value P output from the pressure sensors 72A, 72B (step S507).

Subsequently, the pressure determination section 52A determines, based on the load pressure detection value P acquired again in step S507, whether the load pressure detection value P is out of the predetermined pressure range, specifically, whether the load pressure detection value P is equal to or smaller than the load pressure Pα corresponding to the flat ground traveling performed by the wheel loader 1 or equal to or greater than the load pressure Pγ corresponding to the excavation operation performed by the working device 2 (step S508).

The time measurement section 54 stops the measurement of the time t and performs a reset operation (step S509) when it is determined in step S508 that the load pressure detection value P is not included in the predetermined pressure range (P≤Pα or P≥Pγ) (step S508/YES).

Then, the engine command section 56 outputs a command signal to the engine 3 so as to return the maximum rotational speed Nmax of the engine 3 from the second engine maximum rotational speed Nmax2 to the first engine maximum rotational speed Nmax1 (step S510), and thereafter, the processing by the controller 5 is ended.

The processing by the controller 5 is ended in either of cases when it is determined in step S502 that the load pressure detection value P is not included in the predetermined pressure range (P≤Pα or P≥Pγ) (step S502/NO), when it is determined in step S504 that the measured time t is smaller than the predetermined set time Tth (t<Tth) (step S504/NO), and when it is determined in step S508 that the load pressure detection value P which has been acquired again is included in the predetermined pressure range (Pα<P<Pγ) (step S508/NO).

(Operations of Control by Controller 5)

Next, operations associated with the control performed by the controller 5 will be described with reference to FIGS. 9 to 12.

Figure 9:
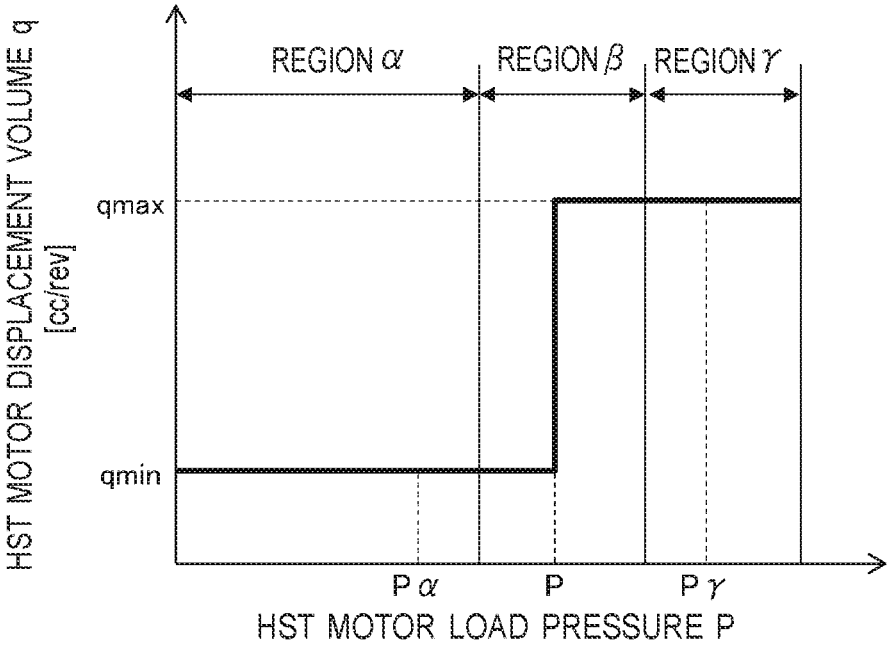
FIG. 9 illustrates a graph showing relationship between HST motor load pressure and HST motor displacement volume.
Figure 10:
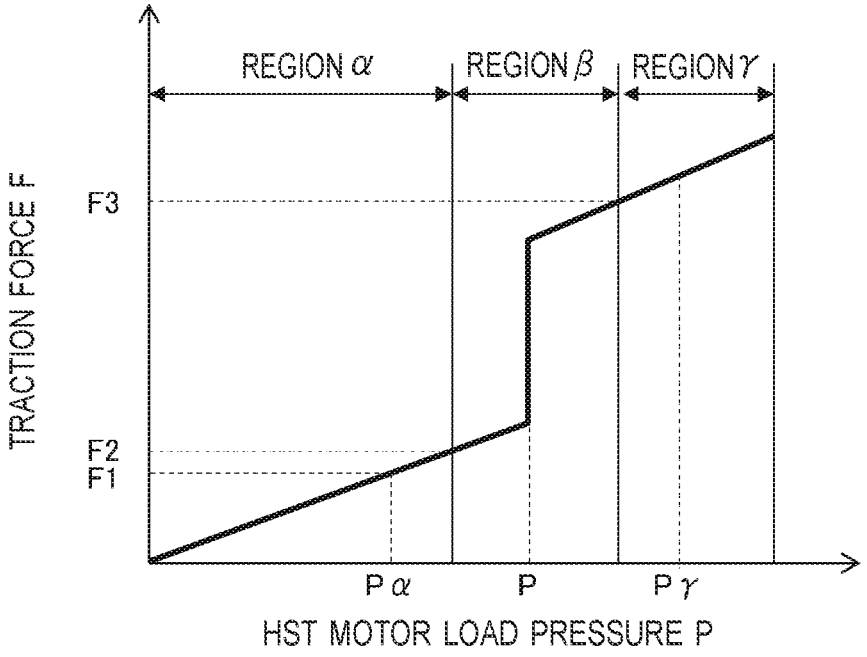
FIG. 10 illustrates a graph showing relationship between HST motor load pressure and traction force.
Figure 11:
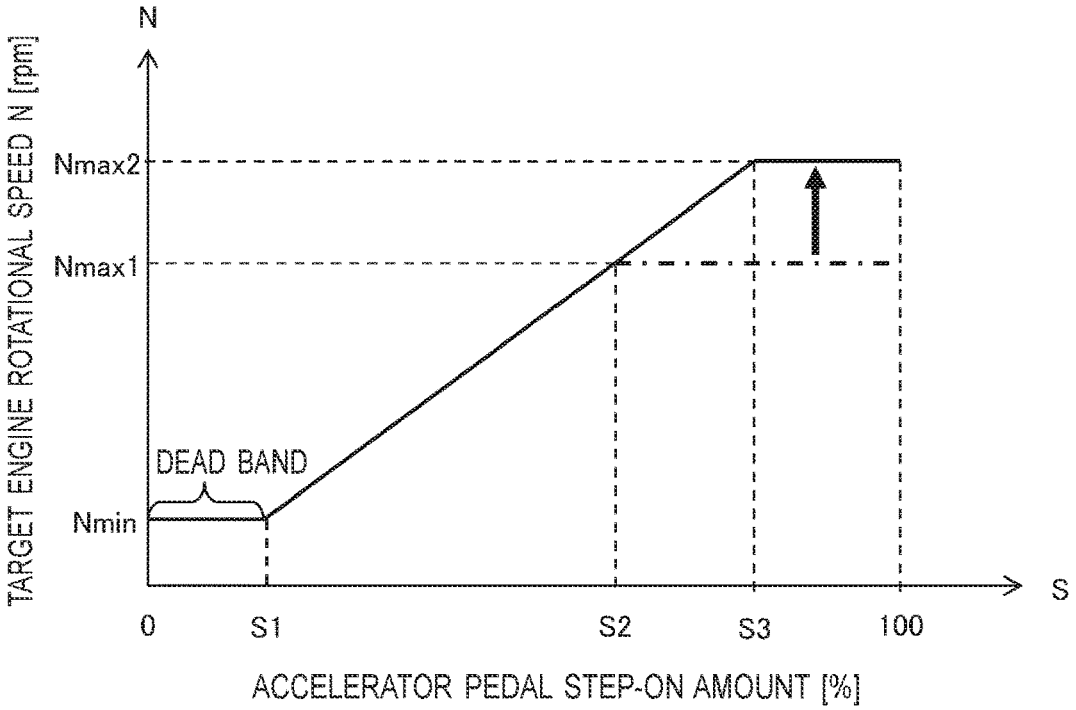
FIG. 11 illustrates a graph showing relationship between an accelerator pedal step-on amount and target engine rotational speed when control by a controller is executed.
Figure 12:
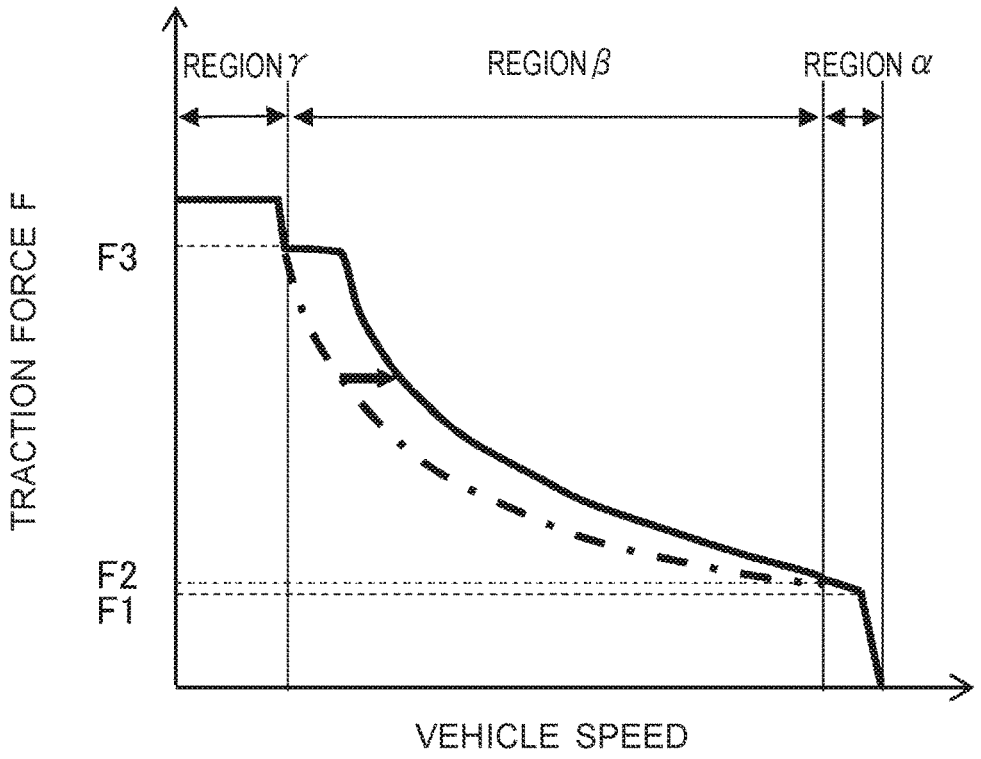
FIG. 12 illustrates a graph showing relationship between vehicle speed and traction force when control by a controller is executed.

FIG. 9 illustrates a graph showing relationship between the load pressure P of the HST motor 42 and the displacement volume q of the HST motor 42 according to the present embodiment. FIG. 10 illustrates a graph showing relationship between the load pressure P of the HST motor 42 and the traction force F according to the present embodiment. FIG. 11 illustrates a graph showing relationship between the accelerator pedal step-on amount and the target engine rotational speed when the control by the controller 5 is executed. FIG. 12 illustrates a graph showing relationship between the vehicle speed and the traction force when the control by the controller 5 is executed.

As illustrated in FIG. 9 and FIG. 10, when the load pressure P of the HST motor 42 is higher than the load pressure Pα corresponding to the flat ground traveling performed by the wheel loader 1 and smaller than the load pressure Pγ corresponding to the excavation operation performed by the working device 2, in other words, when the pressure determination section 52A determines that the load pressure detection value P is included in the predetermined pressure range (step S502 illustrated in FIG. 8/YES), the displacement volume q of the HST motor 42 is instantly increased from the minimum value qmin to the maximum value qmax. Thereby, the traction force F of the vehicle body is also instantly increased (=load pressure P of the HST motor 42×displacement volume q of the HST motor 42).

At this time, as illustrated in FIG. 11, since the maximum rotational speed Nmax of the engine 3 is instantly increased from the first engine maximum rotational speed Nmax1 to the second engine maximum rotational speed Nmax2, the vehicle speed of the wheel loader 1 is also increased in the region β illustrated in FIG. 12. As illustrated in FIG. 11, the step-on amount of the accelerator pedal 61 at the second engine maximum rotational speed Nmax2 is S3 that is greater than the step-on amount S2 corresponding to the first engine maximum rotational speed Nmax1 (S3>S2). In FIG. 12, a traveling performance line before increasing the maximum rotational speed Nmax of the engine 3 (=first engine maximum rotational speed Nmax1) is illustrated with a dashed line, and a traveling performance line after increasing the maximum rotational speed Nmax of the engine 3 (=second engine maximum rotational speed Nmax2) is illustrated with a solid line, respectively.

As described above, when the wheel loader 1 performs hill climb traveling or a dosing operation, in other words, when performing an operation corresponding to the region β, the traction force F is increased while the maximum rotational speed Nmax of the engine 3 is increased as well. Accordingly, horsepower that can be used for traveling is increased, thereby improving traveling performance. On the other hand, when the wheel loader 1 performs the flat ground traveling or an excavation operation, in other words, when performing an operation corresponding to each of the region α and the region γ, the maximum rotational speed Nmax of the engine 3 is not increased, thereby reducing fuel consumption. As a result, according to the control performed by the controller 5, the wheel loader 1 enables to, while reducing the fuel consumption, improve traveling performance only when high traveling performance is required.

Modification

Figure 13:
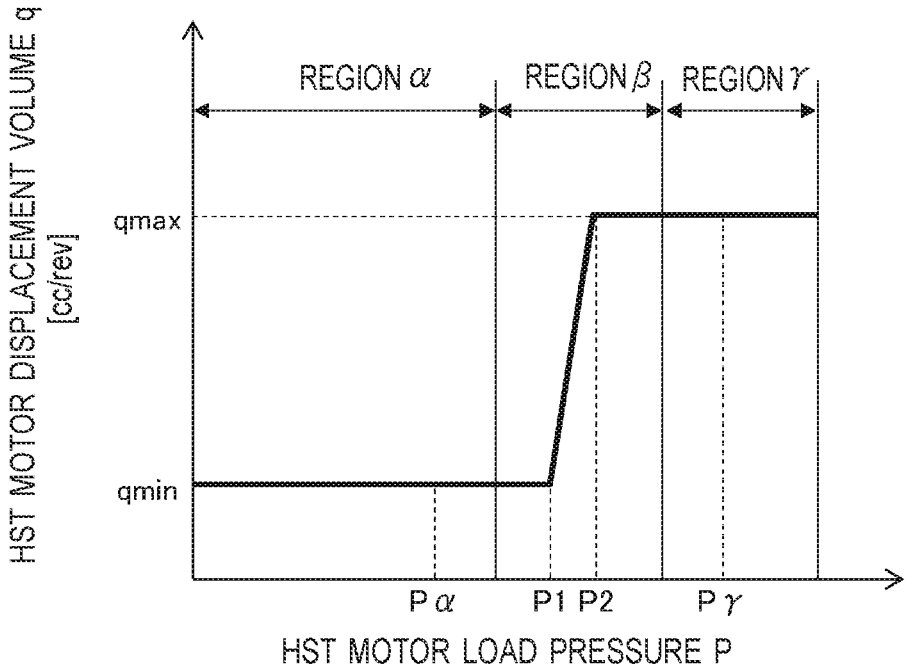
FIG. 13 illustrates a graph showing relationship between HST motor load pressure and HST motor displacement volume according to a modification.
Figure 14:
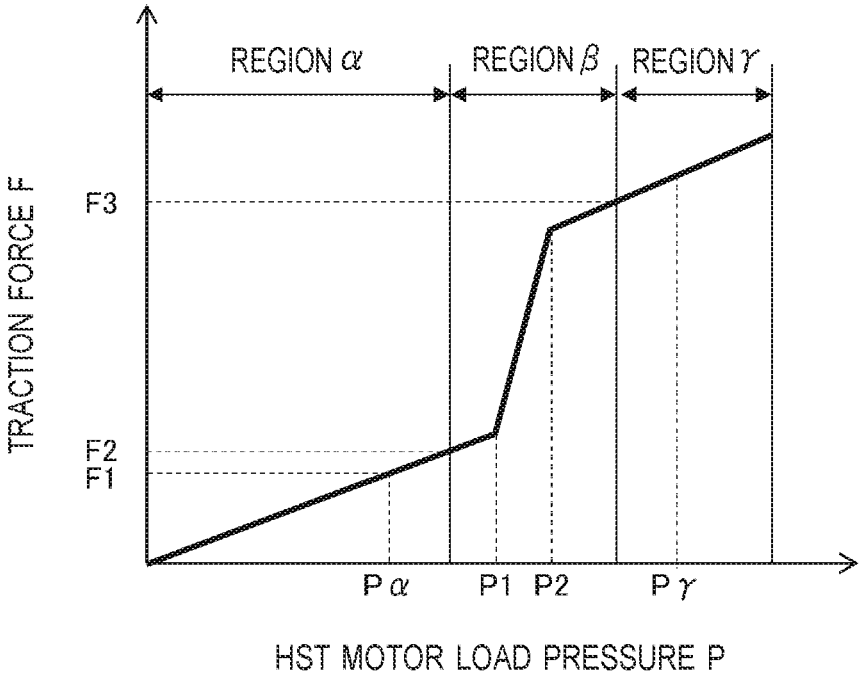
FIG. 14 illustrates a graph showing relationship between HST motor load pressure and traction force according to a modification.

Next, the wheel loader 1 according to a modification of the present invention will be described with reference to FIG. 13 and FIG. 14. In FIG. 13 and FIG. 14, constituent elements which are the same as those described for the wheel loader 1 according to the embodiment above are provided with the same reference signs, and explanation thereof will be omitted.

FIG. 13 illustrates a graph showing relationship between the load pressure P of the HST motor 42 and the displacement volume q of the HST motor 42 according to the modification. FIG. 14 illustrates a graph showing relationship between the load pressure P of the HST motor 42 and the traction force F according to the modification.

In the embodiment described above, the motor command section 55 instantly increases the displacement volume q of the HST motor 42 at an arbitrary pressure value included in the predetermined pressure range from the minimum value qmin to the maximum value qmax. In the present modification, as illustrated in FIG. 13, the motor command section 55 increases the displacement volume q of the HST motor 42 from the minimum value qmin to the maximum value qmax over a first load pressure P1 to a second load pressure P2 in the predetermined pressure range, in other words, providing predetermined width thereto.

With this configuration, as illustrated in FIG. 14, the traction force F of the vehicle body is also increased within the predetermined width (from the first load pressure P1 to the second load pressure P2).

In the present modification, the operations and effects which are the same as those of the embodiment above can be obtained as well.

In the above, the embodiment of the present invention has been described. It should be noted that the present invention is not limited to the embodiment and modification described above, and various other modifications are included. For example, the embodiments described above have been explained in detail in order to clarify the present invention, but are not necessarily limited to those having all the configurations described. In addition, a part of the configuration of the present embodiment can be replaced with that of another embodiment, and the configuration of another embodiment can be added to the configuration of the present embodiment. Furthermore, it is possible to add, delete, or replace another configuration with respect to a part of the configuration of the present embodiment.

For example, in the above-described embodiment and modification, a wheel loader has been described as an aspect of a working vehicle. Meanwhile, the present invention is not limited thereto. The present invention is applicable to, for example, a working vehicle comprising a working device such as a forklift or a tractor, or a vehicle for road work without comprising a working device.

Furthermore, in the above-described embodiment and modification, a fixed displacement hydraulic pump is used as the loading hydraulic pump 43. Meanwhile, the present invention is not limited thereto, but a variable displacement hydraulic pump may be used.

Still further, in the above-described embodiment and modification, in the controller 5, the pressure determination section 52A performs determination based on the range of the load pressure in the region β, in other words, the predetermined pressure range of greater than the load pressure Pα corresponding to the flat ground traveling performed by the wheel loader 1 and smaller than the load pressure Pγ corresponding to the work requiring the maximum traction force of the wheel loader 1 (predetermined second pressure range). Meanwhile, the present invention is not limited to thereto, but a range of the load pressure in a region obtained by adding the region β and the region γ (region β+region γ), in other words, a predetermined first pressure range of greater than the load pressure Pα corresponding to the flat ground traveling performed by the wheel loader 1 (P>Pα) may be used as a reference for determination. In such a configuration, the pressure determination section 52A determines whether the load pressure detection value P detected by the pressure sensors 72A, 72B is included in the predetermined first pressure range or the predetermined second pressure range. In this case, in the controller 5, the processing proceeds to step S509 only when P≤Pα is determined in step S508 illustrated in FIG. 8.

REFERENCE SIGNS LIST

1: wheel loader (working vehicle)
2: working device
3: engine
5: controller
11A: front wheel
11B: rear wheel
41: HST pump (traveling hydraulic pump)
42: HST motor (traveling hydraulic motor)
72A: first pressure sensor (presser sensor)
72B: second pressure sensor (presser sensor)
100A: natural ground (work object)

The invention claimed is:

1. A working vehicle comprising:
an engine;
a variable displacement traveling hydraulic pump that is driven by the engine; and
a variable displacement traveling hydraulic motor that is connected to the traveling hydraulic pump through a closed circuit and transmits drive force of the engine to wheels, wherein
the working vehicle further comprises:
a pressure sensor configured to detect load pressure of the traveling hydraulic motor; and
a controller configured to control the engine and the traveling hydraulic motor,
the controller is further configured to:
determine whether a pressure detection value detected by the pressure sensor is included in a predetermined first pressure range of greater than load pressure of the traveling hydraulic motor corresponding to a state where the working vehicle is traveling on a flat ground, or a predetermined second pressure range of greater than the load pressure of the traveling hydraulic motor corresponding to the state where the working vehicle is traveling on the flat ground and smaller than load pressure of the traveling hydraulic motor corresponding to a state where work requiring maximum traction force of the working vehicle is performed; and
in a case of determining that the pressure detection value detected by the pressure sensor is included in the predetermined first pressure range or the predetermined second pressure range, output a motor command signal to the traveling hydraulic motor so as to increase displacement volume of the traveling hydraulic motor from a minimum value to a maximum value within the predetermined first pressure range or the predetermined second pressure range, and output an engine command signal to the engine so as to increase maximum rotational speed of the engine only within the predetermined first pressure range or the predetermined second pressure range.

2. The working vehicle according to claim 1, wherein
the controller is further configured to increase the displacement volume of the traveling hydraulic motor from the minimum value to the maximum value while providing predetermined width within the predetermined first pressure range or the predetermined second pressure range.

3. The working vehicle according to claim 1, wherein
the controller is further configured to:
start time measurement upon determination that the pressure detection value detected by the pressure sensor is included in the predetermined first pressure range or the predetermined second pressure range;
measure a time while the pressure detection value detected by the pressure sensor is included in the predetermined first pressure range or the predetermined second pressure range; and
output the engine command signal to the engine in a case where the time which has been measured is equal to or more than a predetermined set time.

4. The working vehicle according to claim 3, wherein
the controller is further configured to:
stop the time measurement and perform a reset operation in a case of determining that the pressure detection value detected by the pressure sensor is not included in any of the predetermined first pressure range and the predetermined second pressure range after starting the time measurement; and output a command signal to the engine so as to return the maximum rotational speed, which has been increased, to an original state.

5. The working vehicle according to claim 1, further comprising a working device configured to excavate a work object, wherein the state where the work requiring the maximum traction force of the working vehicle is performed comprises a state where the working device is performing an excavation operation.

* * * * *